United States Patent [19]

Vella

[11] Patent Number: 4,505,609

[45] Date of Patent: Mar. 19, 1985

[54] SHELTER FRAME COUPLINGS

[76] Inventor: John C. Vella, 90 Bellstone Ave., Westbrook, Conn. 06498

[21] Appl. No.: 485,300

[22] Filed: Apr. 14, 1983

[51] Int. Cl.[3] ..... F16B 7/00

[52] U.S. Cl. ..... 403/91; 403/170; 403/174; 403/297

[58] Field of Search ..... 182/178, 179; 403/91, 403/97, 170, 174, 178, 297, 248, 290, 374, 153; 52/726; 411/44, 55

[56] References Cited

U.S. PATENT DOCUMENTS

| | | | |
|---|---|---|---|
| 1,154,883 | 9/1915 | Portman | 403/153 |
| 2,212,455 | 8/1940 | Reed | 403/170 X |
| 3,545,796 | 12/1970 | Nicholls | 403/297 X |
| 3,922,481 | 11/1975 | Lewis | 403/170 X |

FOREIGN PATENT DOCUMENTS

| | | | |
|---|---|---|---|
| 1267823 | 5/1968 | Fed. Rep. of Germany | 182/178 |
| 499156 | 11/1954 | Italy | 403/97 |
| 586807 | 4/1977 | Switzerland | 403/353 |
| 226229 | 3/1926 | United Kingdom | 403/94 |
| 405110 | 2/1934 | United Kingdom | 403/297 |

*Primary Examiner*—Thomas F. Callaghan

*Attorney, Agent, or Firm*—McCormick, Paulding & Huber

[57] ABSTRACT

Co-operating coupling members for securing together elongated tubular frame elements in the construction of a shelter. The said coupling members comprise two configurations, each of which is adapted to be received in the open end of an associated frame element. With these two coupling configurations, as many as five or more frame elements can be connected at a juncture at selected angles to each other.

6 Claims, 11 Drawing Figures

SHELTER FRAME COUPLINGS

BACKGROUND OF THE INVENTION

This invention relates to the construction of more or less temporary shelters to cover articles against damage or destruction by weather. For example, one often sees a shelter built around a boat to protect it while on land during the nonboating season. Another use for a shelter may be to cover an automobile or other vehicle that may be placed in the owner's yard. A still further use for a shelter is not for the purpose of covering any particular object, but such a shelter construction can be used as a greenhouse.

The framework for such shelters is often made of elongated frame pieces, most often tubular, which are connected together in such a manner that they will provide the support for plastic sheeting, canvas or the like which will be secured to the frame elements in any manner desired to provide the protection against the elements for anything in the interior.

The invention relates more particularly to the construction of co-operating coupling members which are used to connect the elongated frame pieces in the erection of a frame for the shelter.

DESCRIPTION OF THE PREFERRED EMBODIMENT

Figure 1:
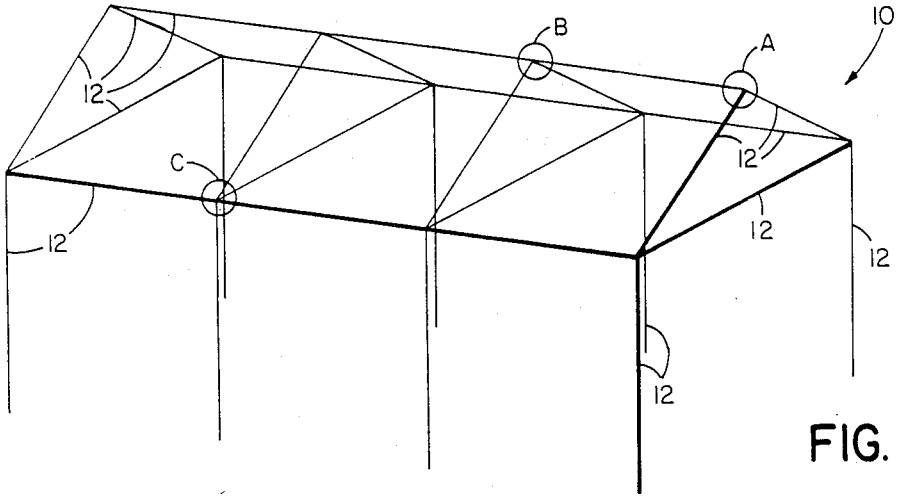
FIG. 1 is a schematic illustration of how a shelter frame may be erected.

FIG. 1, for purposes of illustration, shows the manner in which a shelter frame 10 may be erected by interconnection of a plurality of elongated frame elements 12, 12. A frame piece 12 is generally made of metal, but it may be made of plastic or the like, and it is tubular. At any point of connection in the erection of a frame, there will be at least two frame pieces 12, 12 joined together, but more often there will be a connection of three such frame pieces as shown by the encircled area A in FIG. 1; four such pieces as indicated by the encircled area B in FIG. 1; or five or more such pieces as shown in encircled area C in FIG. 1.

Figure 2:
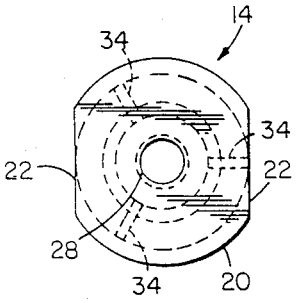
FIG. 2 is an end view of a first type of one of the cooperating coupling members.
Figure 3:
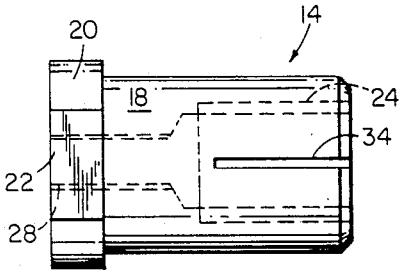
FIG. 3 is a side view of the coupling member shown in FIG. 2.
Figure 6:
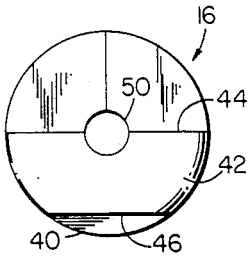
FIG. 6 is an end view of a second form of a coupling member provided in accordance with the invention.
Figure 7:
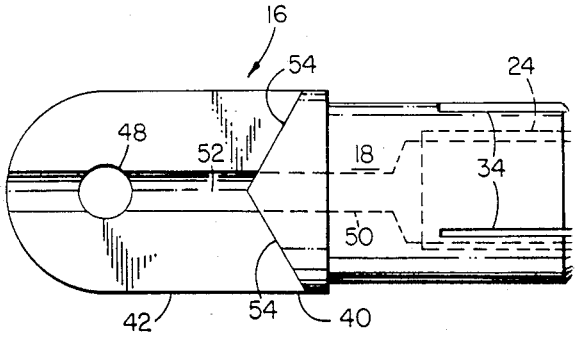
FIG. 7 is a top plan view of the coupling member illustrated in FIG. 6.
Figure 8:
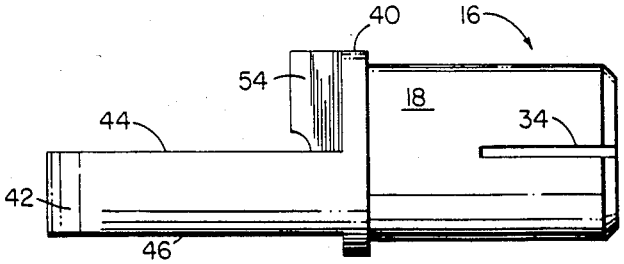
FIG. 8 is side elevational view of the co-operating coupling member shown in FIGS. 6 and 7.

In accordance with the present invention, there are two co-operating coupling members provided, one of which is identified by the reference number 14 in FIGS. 2 and 3 and the other of which is shown in some detail in FIGS. 6–8 wherein that coupling member is identified by the reference number 16. The said coupling members 14 and 16 are preferably molded in plastic which is fairly rigid but nonetheless permits of some flexibility. Each such coupling member 14 and 16 has a cylindrical body portion 18 (FIGS. 3 and 8) which is to be inserted in the open end of an associated frame piece 12.

Referring particularly to the coupling member 14 shown in FIGS. 2 and 3, it will be seen that this member has a head 20 which in connection to a frame piece will not be permitted to be thrust into the frame piece, and it will be observed that the said head is generally cylindrical in shape and preferably is of the same diameter as the frame piece with which the member 14 is to be associated. It will also be seen that the head 20 has wrench flats 22 which can be engaged by an appropriate wrench to locate the rotated position of the coupling member 14 about the axis of a frame piece 12 into which it is inserted. Also, the wrench head 20 is to be used in tightening the coupling member to a threaded stud which will be described later.

Figure 4:
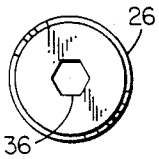
FIG. 4 is an end view of an expander plug utilized with each type of coupling member provided in accordance with the invention.
Figure 5:
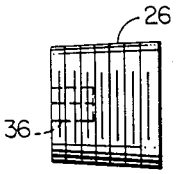
FIG. 5 is a side view of the plug shown in FIG. 4.

The coupling member 14 has an axial bore extending throughout its length, and this bore is diametrically enlarged and threaded as indicated at 24 in the body portion 18 of the coupling member, this for the purpose of receiving a threaded expansion plug 26 shown in FIGS. 4 and 5. The reduced diameter end of the bore is also threaded as indicated at 28, this for the purpose of connecting the coupling member 14 to a threaded stud, such as the stud 30 in FIG. 9 or the bolt 32 in FIG. 10.

It is important to note that the body portion 18 of each coupling member is provided with a plurality of circumferentially spaced slots 34, 34 (three illustrated) at the end of the body portion which is inserted into the associated frame piece and extending longitudinally therefrom. These slots 34, 34 permit diametric expansion of the body portion 18 when the tapered plug 26 is threaded into the threaded opening 24. In this connection, it is important to note that the externally threaded expansion plug 26 of FIGS. 4 and 5 has a wrench receiving socket 36 in its small diameter end so that it can be engaged by a suitable elongated tool (not shown) thrust through the opening 28 in the head 20, and by rotating such tool the expansion plug 26 may be drawn into the inserted end of the body portion 18 and diametrically expand the said body portion into a tight and secure fit within the open end of an associated frame piece 12. Thus, the coupling member 14, or the coupling member 16, may be firmly secured in a selected rotated position in the end of a frame piece.

Referring now to the other coupling member 16 as illustrated in FIGS. 6–8, it has the same body portion 18 as does the coupling member 14. However, it has a different head 40 which includes a longitudinally extending flange 42. While the head 40 is generally cylindrical in design and its diameter is made to match or to substantially match the outside diameter of a frame piece 12, it does not have a flat surface as does the head 20 of the coupling member 14. Instead, it has the flange 42 extending therefrom longitudinally, but it is to be noted that the flange 42 is provided with flat faces 44 and 46, and it is also to be noted that the flange 42 is offset radially from the axis of the coupling member 16 and its coincident axis associated frame piece 12. The flange 42 extends outwardly from the coupling member 16 when it is inserted into a frame piece, and the said flange has a transverse opening 48 which is of sufficient diameter to receive either the stud 30 or the bolt 32 quite comfortably and possibly with room to spare. Accordingly, the coupling piece 16 and its associated frame member may be connected to a stud 30 or a bolt 32 and extend at a right angle to the axis of a frame piece 12 having a coupling member 14 inserted into one end thereof. Also, it can be rotated by the loose fit between the aperture 48 and the accommodating stud 30 or bolt 32 so that the coupling member 16 and its associated frame piece may be directed at any angle from a plane which includes the axis of the coupling member or coupling members 14 and associated frame pieces.

Like the coupling member 14, the coupling member 16 has a bore extending along its axis and with the enlarged portions in the body portion 18 precisely like that provided in the coupling member 14. It also has a reduced diameter portion of its bore which is identified by the reference number 50, which is similar to the threaded portion of the member 14 and which is identified by the number 28 however the reduced diameter portion 50 need not be threaded as was and is the portion 28 of the member 14.

It should be noted that the radially inner flat face 44 of the flange 42 has a groove 52 extending through it which forms a part of the opening or bore 50 so that a tool can be inserted along the groove and through the opening 50 to operate an expansion plug 26 to tighten a coupling member 16 in a frame piece 12 as described earlier.

Therefore, the coupling member 16 and its associated frame piece are to be connected with a coupling member 14 and its associated frame piece transversely thereof. That is, the coupling member 16 swings or can be adjusted about and fixed at an angle on a stud 30 or bolt 32 extending longitudinally on the axis of a coupling member 14 and its associated frame piece. While the coupling member 16 and its associated frame piece will be at ninety degrees to the axis of the stud and the coupling member 14 it can be located at any angle desired or selected with respect to a plane containing the axis of the coupling member 14.

It should also be noted that as far as the angular disposition about the axis of a coupling member 14 and its associated frame piece, the flange 42 on the coupling 16 is provided with shoulders 54, 54 near its base which serve to limit the swing of one coupling member 16 relative to another coupling member 16 about the axis of the stud passing through the flange opening 48.

Figure 9:
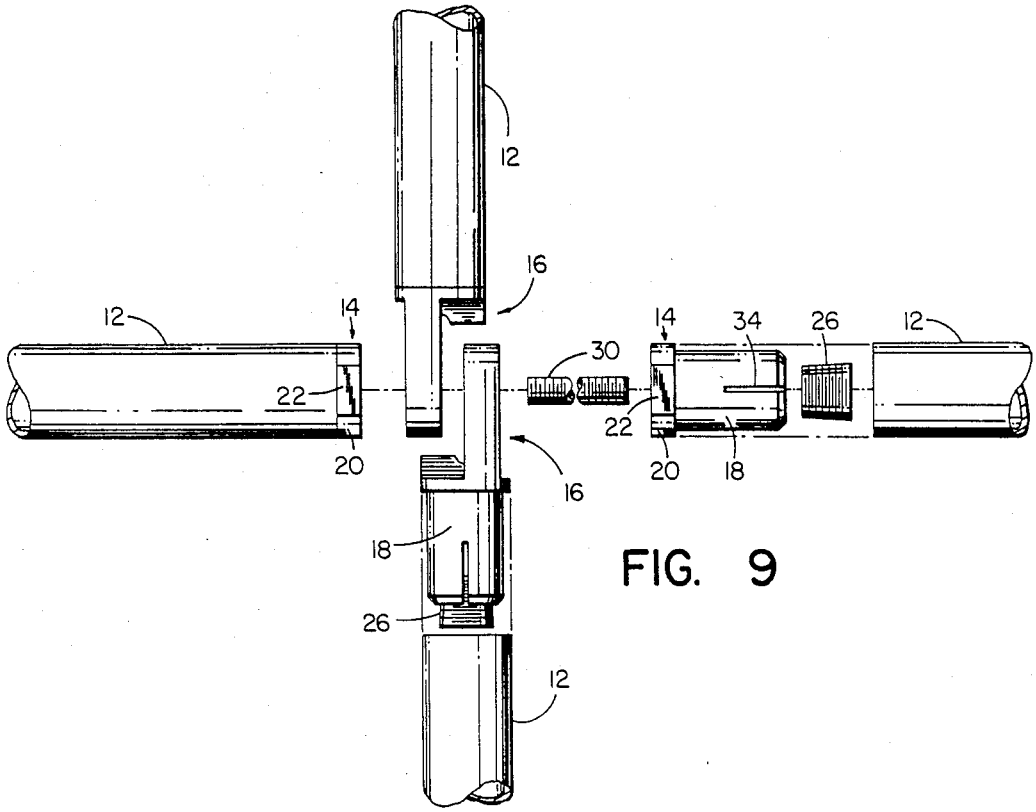
FIG. 9 is an exploded view illustrating the manner in which the co-operating coupling members and their associated frame pieces are connected at a point of juncture where four such frame pieces are connected.
Figure 10:
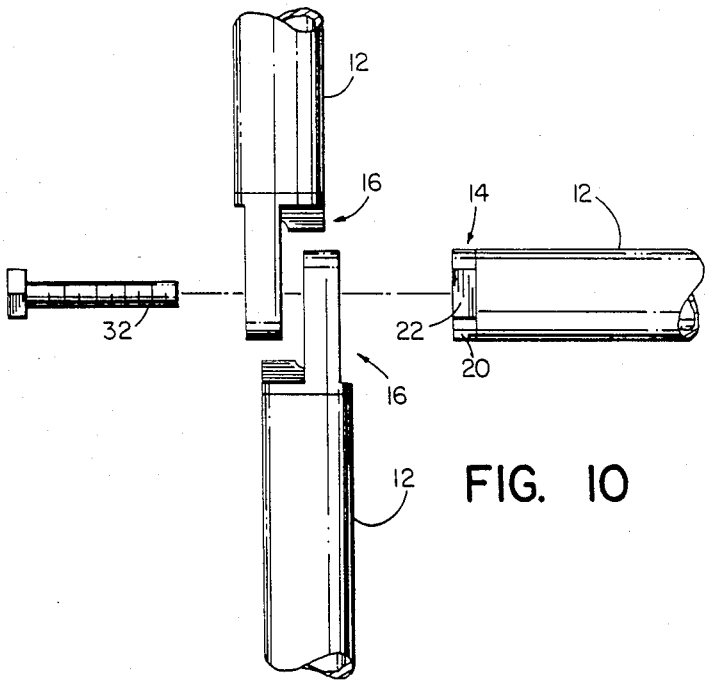
FIG. 10 is a view similar to FIG. 9 but it illustrates how two or three frame pieces may be connected at an angle.
Figure 11:
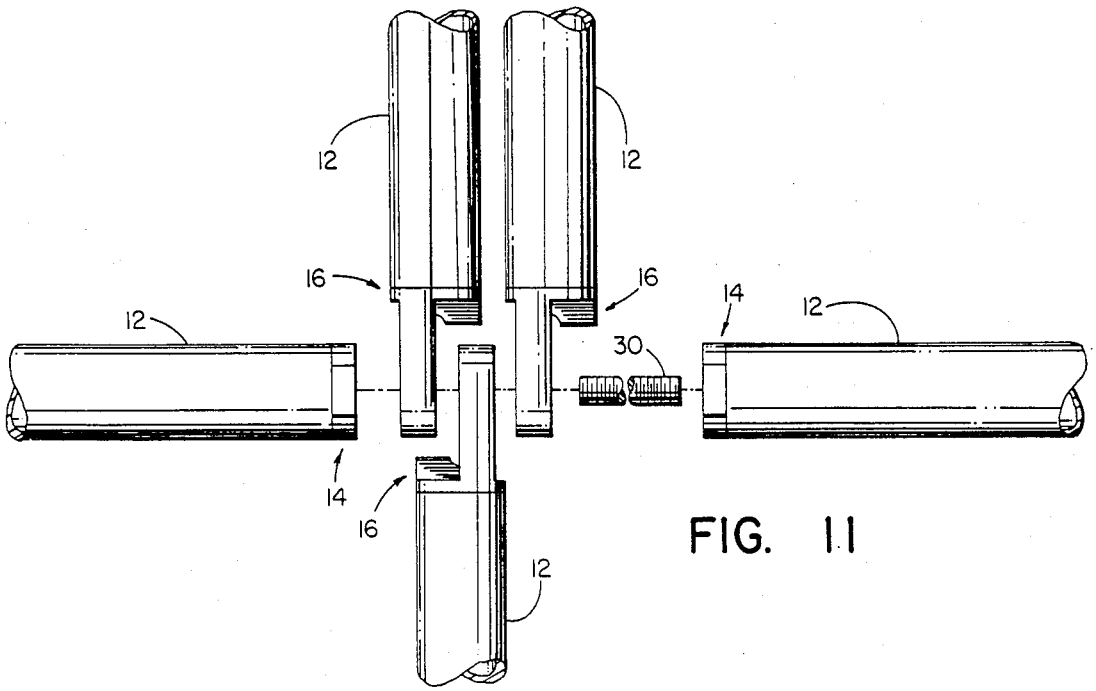
FIG. 11 is a similar view illustrating the manner in which five or more such frame pieces may be connected.

FIGS. 9–11 illustrate the presently preferred and desirable ways of connecting the frame elements using the coupling members provided by this invention.

In FIG. 9, for example, there is shown a manner of connecting four such frame pieces together utilizing the stud 30. In this sort of connection, the stud 30 should be provided with threads accommodating at each of its ends the insertion within a coupling member 14, preferably by threading the stud so that each end presents a "right hand" thread portion to engage the threads in the opening 28 of a coupling head 20. Each such coupling member is, of course, connected with a frame piece 12. In this sort of arrangement the coupling members 16 and 16 which are associated with frame pieces 12, 12 may be firmly anchored together on the stud 30 at selected angles to any plane which includes the axis of the connected coupling members 14 at the ends of the stud 30. Each such frame member associated with a coupling member 16 may be extended from a plane including the stud 30 at a selected angle, and they may be adjusted as to angle between each other, that is, they can be adjusted with respect to the coupling member and its associated frame member 12 with respect to another coupling member and its associated frame piece 12.

Similarly, FIG. 10 shows an arrangement whereby the stud 32 has a cap on it which can be tightened within the coupling member 14 and the coupling members 16, 16 and their associated frame pieces directed at angles as selected. This, of course, also embraces the possibility of having a connection between a frame piece 12 and the coupling member 14 and only one frame piece 12 having a coupling member 16.

In FIG. 11 there is illustrated a connection wherein two frame pieces 12, 12 associated with coupling members 14, 14 are connected angularly with frame pieces 12, 12 having coupling members 16, 16 wherein the total number is more than four. While in FIG. 11 the two frame pieces having coupling members 16, 16 are shown parallel to each other, in actual practice they will not be parallel. Additionally, it would be understood that other frame pieces can be connected using the coupling members 16, 16 along the stud 30 so that more than five frame pieces can be connected together at one point of juncture or joint.

I claim:

1. The combinatin of co-operating coupling members for tubular frame pieces in the construction of a shelter, each such member being expandable for secure fit connection in an open end of such frame piece at a selected rotation position therein, at least one such member being provided with a threaded axial opening to receive a stud projecting therefrom, and at least one other such coupling member being provided with a longitudinally extending flange at one end having an opening through which the projecting portion of the stud may be received for rotation of the said other such coupling member thereon, whereby a first frame piece connected to said one such member and second frame piece connected to said other such member may be coupled with the axis of the second frame piece extending at a selected angle to a plane in which the axis of the first frame piece resides, and each coupling member having a generally cylindrical tubular body portion which is inserted into an open end of a frame piece and which is longitudinally slotted from its inserted open end to permit diametric expansion of the said body portion, each such coupling member also having an axial bore throughout its length communicating with the body portion, and the body portion of each such member being internally threaded adjacent its open end in a frame piece to receive a tapered expansion plug, and an externally threaded tapered expansion plug adapted for engagement by a tool thrust through the bore of the coupling member to rotate the plug and thus draw it into the open end of the body portion to expand the same and thus secure the coupling member in the selected rotated position within the open end of the frame piece.

2. The combination of claim 1 wherein the stud is threaded at each of its ends to be threaded into a one such member, whereby two frame pieces, each connected to a one such member, can be coupled together and to at least one frame piece connected to a said other such member.

3. The combination of claim 1 wherein the longitudinally projecting flange of the said other such coupling member is offset from the coinciding axes of the coupling member and the frame piece with which it is connected.

4. The combination of claim 1 wherein the longitudinally projecting flange of the said other such coupling member has flat faces and is offset from the coinciding axes of the coupling member and the frame piece with which it is connected, and wherein each such other coupling member also has shoulders defined at the base of its flange to limit the angle of rotation of one such other coupling member relative to another simliar member when they are assembled on a single stud with flat faces of their flanges in opposed adjacent relationship.

5. The combination of claim 2 wherein the longitudinally project flange of the said other such coupling member has flat faces and is offset from the coinciding axes of the coupling member and the frame piece with which it is associated, and wherein each such other coupling member also has shoulders defined at the base of its flange to limit the angle of rotation of one such other coupling member relative to another similar member when they are assembled on a single stud with flat faces of their flanges in opposed adjacent relationship.

6. The combination of claim 3 wherein the longitudinally projecting flange of the said other such coupling member has flat faces and is offset from the coinciding axes of the coupling member and the frame piece with which it is associated, and wherein each such other coupling member also has shoulders defined at the base of its flange to limit the angle of rotation of one such other coupling member relative to another similar member when they are assembled on a single stud with flat faces of their flanges in opposed adjacent relationship.

* * * * *